United States Patent [19]

Mileham

[11] 4,187,432

[45] Feb. 5, 1980

[54] SOURCE HOLDER FOR MOUNTING RADIOACTIVE FOIL AND HOLDER-FOIL ASSEMBLY

[75] Inventor: Jay R. Mileham, Tonawanda, N.Y.

[73] Assignee: NRD, Division of Mark IV Industries, Inc., Grand Island, N.Y.

[21] Appl. No.: 887,208

[22] Filed: Mar. 16, 1978

[51] Int. Cl.[2] ..... G21G 4/00

[52] U.S. Cl. ..... 250/493; 52/823; 250/492 R

[58] Field of Search ..... 250/385, 381, 493, 496; 340/232; 52/823

[56] References Cited

U.S. PATENT DOCUMENTS

| | | | |
|---|---|---|---|
| 2,495,347 | 1/1950 | Ritz-Woller | 52/823 |
| 2,500,897 | 3/1950 | Friedman | 52/823 |
| 2,700,111 | 1/1955 | Jacobs et al. | 250/496 |
| 3,500,368 | 3/1970 | Abe | 250/385 |
| 4,075,487 | 2/1978 | Larsen | 250/385 |

*Primary Examiner*—Harold A. Dixon

*Attorney, Agent, or Firm*—Joseph P. Gastel

[57] ABSTRACT

A holder for mounting a radioactive foil comprising a coined stainless steel disc having an opening with a lip surrounding the opening and providing a shelf to support the foil, a counterbore portion adjacent the lip providing a chamber for receiving the foil, and a readily deformable portion remote from the lip for permitting deformation of the chamber wall inwardly to retain the foil in the counterbore. A holder-foil assembly is disclosed which consists of a radioactive foil mounted in the above-described holder.

2 Claims, 5 Drawing Figures

SOURCE HOLDER FOR MOUNTING RADIOACTIVE FOIL AND HOLDER-FOIL ASSEMBLY

BACKGROUND OF THE INVENTION

The present invention relates to an improved disc-type source holder for radioactive foils used as an ion source and to an assembly of said holder and a radioactive foil.

By way of background, source holders are used to mount a radioactive foil in devices such as ionization chamber smoke detectors. Insofar as pertinent here, in the past disc-type source holders were used which had a precisely sized circular opening therein and which utilized various types of brackets to retain a radioactive foil in position against the disc so that it would radiate through the opening. Holders of this prior art type were deficient in that a relatively complex assembly operation was required to mount a foil on a holder. The same was true of other prior art types of disc holders which were riveted together to provide a sandwich type of arrangement with a foil positioned therebetween.

SUMMARY OF THE INVENTION

It is accordingly one important object of the present invention to provide an improved disc type of radioactive foil holder which can be fabricated in a simple manner, and on which a radioactive foil can be mounted in an extremely simple manner and which is so dimensioned so as to permit a precise amount of radiation to project through an opening in the holder and which, in addition to all the foregoing, can be fabricated at low cost and assembled with the radioactive foil at low cost. Other objects and attendant advantages of the present invention will readily be perceived hereafter.

The present invention relates to a source holder for mounting a radioactive foil comprising a disc, an opening in said disc, a lip on said disc, a first wall on said lip defining the size of a first portion of said opening through which said foil is to radiate, a second wall on said lip oriented transversely to said first wall for providing a shelf to support said foil, a counterbore portion in said opening including a third wall extending axially relative to said second wall on the opposite side thereof from said first wall for providing a chamber for receiving said foil, and a readily deformable portion adjacent said third wall remote from said lip for enhancing deformation of said third wall inwardly toward said opening to retain said foil in said counterbore. The present invention also relates to an improved combined holder and radioactive foil assembly utilizing the foregoing holder. The various aspects of the present invention will be more fully understood when the following portions of the specification are read in conjunction with the accompanying drawings wherein:

DESCRIPTION OF THE PREFERRED EMBODIMENTS

Figure 1:
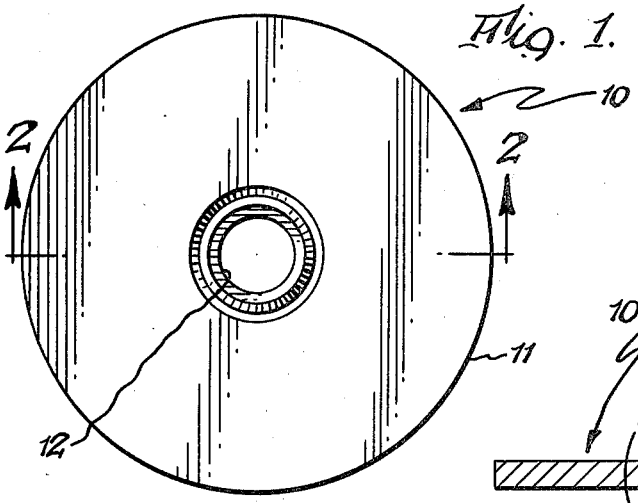
FIG. 1 is a plan view of the improved source holder of the present invention.
Figure 2:
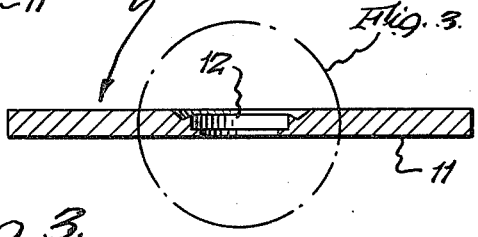
FIG. 2 is a cross sectional view taken substantially along line 2—2 of FIG. 1.

The improved holder 10 of the present invention comprises a disc which is preferably fabricated of stainless steel which maintains its integrity during a fire situation and which also does not require a costly plating operation. An opening 12 is formed in disc 11. Opening 12 includes a first opening portion 13 which is defined by wall 14 of lip portion 15 which is formed integrally as a part of disc 11. Opening 12 also includes a counterbore portion 16 which is defined by wall 17. The chamber defined by wall 17 receives a radioactive foil 19 which is supported by wall portion 20 of lip 15. Holder 10 may be fabricated in any suitable manner, such as by a combined or progressive punching and stamping operation.

An annular wall portion 21 is oriented at an acute angle alpha, which in this particular case is 62° but which can be of any other suitable size. Essentially, wall 21 constitutes a relieved portion of the disc so that after the foil 19 has been mounted in the position shown in FIG. 4, the weakest outer portion 22 at the junction of walls 17 and 21 can be deformed to the condition shown in FIG. 4 to retain foil 19 firmly in pposition. An additional annular wall portion 23 intersects wall portion 21 and also forms an obutse angle with outer surface 24 of disc 11 which is opposite to disc surface 25 to which lip 15 is adjacent.

It is to be especially noted that the diameter D of opening portion 13 is precisely controlled during manufacture so that the amount of radiation passing through opening 13 from foil 19 is a precise amount. As noted above, disc 10 is formed by a combined punching and deforming operation. This permits it to be made at relatively low cost while retaining the accuracy of opening portion 14 through which the radiation projects. In addition, the providing of a relatively easily deformable weakened portion 22 permits the foil 19 to be mounted securely on holder 10 by pressing, which is an extremely simple, low cost and expedient procedure. Portion 22 is readily deformable because surface 21 is essentially relieved.

Figure 3:
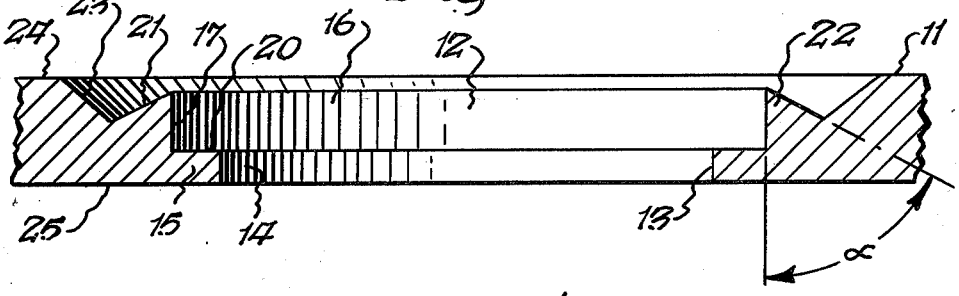
FIG. 3 is an enlarged view of a portion of FIG. 2.
Figure 4:
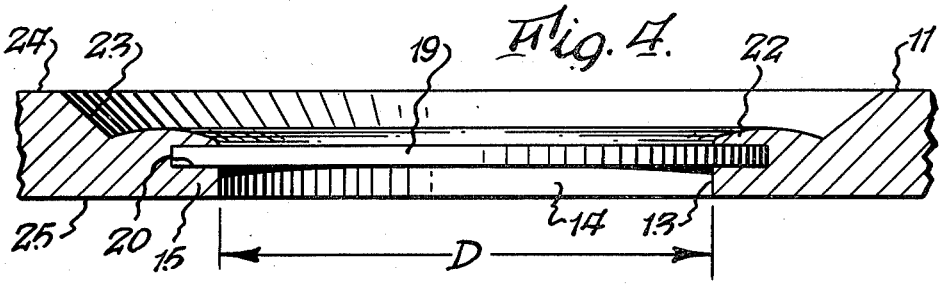
FIG. 4 is a view similar to FIG. 3 but showing a radioactive foil mounted on the holder.
Figure 5:
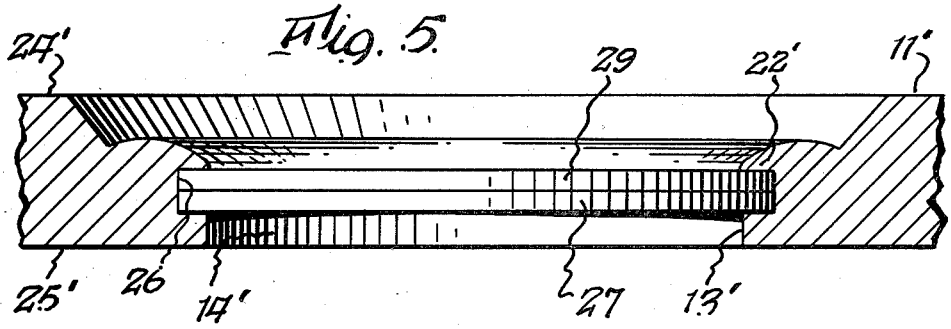
FIG. 5 is a cross sectional view similar to FIG. 4 but showing an alternate embodiment for mounting two foils.

In FIG. 5 a modified form of the present invention is shown. The only dofference between FIG. 4 and FIG. 5 is in the thickness of the discs, the size of the opening through which the foil radiates, and the different dimensions of the chamber defined by wall 26 so that it can receive two foils 27 and 29. Foil 27 is oriented so that it will radiate through opening 14' and foil 29 radiates through the opening defined by the deformed weakened portion 22', which is analogous to portion 22 of FIG. 3. While the size of the opening which is formed as a result of deforming portion 22' to the position shown in FIG. 5 cannot precisely be controlled to the same extent as the size of opening 14', the fact remains that it can be controlled to a sufficient degree so that the amount of radiation through the opening defined by deformed portion 22' can be commercially utilized in dual chamber smoke detectors.

It is to be noted that disc 11 carrying foil 19 functions as an electrode, and lead wires may be connected thereto by any suitable means, such as brazing, soldering, welding, or wire wrapping around a tang attached to disc 11. Furthermore, as an example of the dimensioning, in a specific structure, opening 13 is 0.165 inches in diameter and opening 13' is 0.180 inches in diameter. Disc 11 is 0.035 inches thick and 1.000 inches in diameter. Disc 24' is 0.50 inches thick and 1.000 inches in diameter. The remainder of the dimensions of the holders of FIGS. 4 and 5 are drawn substantially to scale and can be derived from the drawings using the foregoing dimensions as a basis. However, the foregoing is solely by way of example, and it will be appreciated that the dimensions may be changed for different applications or devices, as desired. Foils 19, 27 and 29 are all circular discs. The primed numerals in FIG. 5 correspond to the unprimed numerals of FIG. 4 and represent analogous elements of structure.

While the foils 19, 27 and 29 have been shown as being circular, it will be appreciated that they can be of any suitable shape, such as square, and that the counterbores, such as 16, will be of a complementary shape. Also, while the outer portion 22 has been shown as being uniformly deformed to hold disc 19, it will be appreciated that, if desired, it may be deformed only at circumferentially spaced locations.

While preferred embodiments of the present invention have been disclosed, it will be understood that the present invention is not limited thereto but may be otherwise embodied within the scope of the following claims.

What is claimed is:

1. A source holder for mounting a radioactive foil comprising a disc, an opening in said disc, a lip on said disc, a first wall on said lip defining the size of a first portion of said opening through which said foil is to radiate, a second wall on said lip oriented transversely to said first wall for providing a shelf to support said foil, a counterbore portion in said opening including a third wall extending transversely relative to said second wall on the opposite side thereof from said first wall for providing a chamber for receiving said foil, a readily deformable portion adjacent said third wall remote from said lip for permitting deformation of said third wall inwardly toward said opening to retain said foil in said counterbore, said disc including first and second opposite surfaces, and said lip being adjacent said first surface, and said fifth wall merging into said second surface.

2. A source holder as set forth in claim 1 wherein said fifth wall extends at an obtuse angle to said second surface.

* * * * *